US009440810B2

(12) United States Patent
Okura

(10) Patent No.: US 9,440,810 B2
(45) Date of Patent: Sep. 13, 2016

(54) IMAGE FORMING APPARATUS AND SHEET TRAY

(71) Applicant: KYOCERA Document Solutions Inc., Osaka-shi, Osaka (JP)

(72) Inventor: Yoshimasa Okura, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/722,389

(22) Filed: May 27, 2015

(65) Prior Publication Data

US 2015/0344248 A1 Dec. 3, 2015

(30) Foreign Application Priority Data

May 28, 2014 (JP) ..... 2014-110153

(51) Int. Cl.

| | |
|---|---|
| ***B65H 1/04*** | (2006.01) |
| ***B65H 11/00*** | (2006.01) |
| ***B65H 3/44*** | (2006.01) |
| ***B65H 5/00*** | (2006.01) |
| ***G03G 15/00*** | (2006.01) |

(52) U.S. Cl.

CPC *B65H 5/00* (2013.01); *B65H 1/04* (2013.01); *B65H 3/44* (2013.01); *G03G 15/6514* (2013.01); *B65H 2405/111646* (2013.01); *B65H 2405/121* (2013.01); *B65H 2405/324* (2013.01); *B65H 2407/21* (2013.01)

(58) Field of Classification Search

CPC ..... B65H 2407/21; B65H 3/44; B65H 5/26; B65H 1/04; B65H 1/266; B65H 1/26; G03G 15/6514; G03G 2215/00392

See application file for complete search history.

(56) References Cited

U.S. PATENT DOCUMENTS

2014/0212195 A1* 7/2014 Aoyama ..... G03G 15/6529 399/405
2015/0061214 A1* 3/2015 Woo ..... B65H 3/0607 271/117

FOREIGN PATENT DOCUMENTS

| | | | |
|---|---|---|---|
| JP | 08104449 | A * | 4/1996 |
| JP | 2007279273 | A * | 10/2007 |
| JP | 2007279565 | A * | 10/2007 |
| JP | 2008024396 | A * | 2/2008 |
| JP | 2008-87877 | | 4/2008 |
| JP | 2008087877 | A * | 4/2008 |
| JP | 2009256053 | A * | 11/2009 |

* cited by examiner

*Primary Examiner* — Luis A Gonzalez
(74) *Attorney, Agent, or Firm* — Gerald E. Hespos; Michael J. Porco; Matthew T. Hespos

(57) ABSTRACT

An image forming apparatus includes a housing, a sheet conveyance passage, a main tray, a downstream tray, and an elastic member. The main tray includes a first fastening portion and a first support portion, and is pivotable about an axis of the first support portion to thereby be openable and closeable with respect to the housing. The downstream tray includes a second fastening portion, and a second support portion disposed further inside the housing than the first support portion, the downstream tray overlapping the main tray, and being pivotable about an axis of the second support portion and thereby relatively movable with respect to the main tray. The elastic member is expandable and contractible and fastened on the first fastening portion of the main tray and the second fastening portion of the downstream tray.

8 Claims, 8 Drawing Sheets

IMAGE FORMING APPARATUS AND SHEET TRAY

INCORPORATION BY REFERENCE

This application is based on Japanese Patent Application No. 2014-110153 filed with the Japan Patent Office on May 28, 2014, the contents of which are hereby incorporated by reference.

BACKGROUND

The present disclosure relates to an image forming apparatus and a sheet tray for forming an image on a sheet.

Conventionally, there are known image forming apparatuses for forming an image on a sheet. An image forming apparatus includes an apparatus main body, and a cover member configured to be openable and closeable with respect to the apparatus main body. The cover member in an open state allows a sheet to be placed thereon. The sheet is conveyed into the apparatus main body to have an image formed thereon. Further, the image forming apparatus includes a position regulating portion. The cover member comes into contact with the position regulating portion in the course of being opened with respect to the housing, whereby the opening angle of the cover member is regulated.

SUMMARY

An image forming apparatus according to an aspect of the present disclosure includes a housing including an internal space, a sheet conveyance passage, a main tray, a downstream tray, and an elastic member. The sheet conveyance passage extends in the internal space. The main tray includes a first fastening portion, and a first support portion disposed at a lower end of the main tray. The main tray is pivotable about an axis of the support portion to thereby be openable and closeable with respect to the housing. The main tray allows a sheet to be conveyed into the sheet conveyance passage to be placed thereon in an open state with respect to the housing. The downstream tray includes a second fastening portion, and a second support portion disposed further inside the housing than the first support portion. The downstream tray overlaps the main tray, and is pivotable about an axis of the second support portion and thereby relatively movable with respect to the main tray to allow a downstream part of the sheet in a sheet conveying direction to be placed thereon. The elastic member is expandable and contractible. One end of the elastic member is fastened on the first fastening portion of the main tray, and the other end of the elastic member is fastened on the second fastening portion of the downstream tray.

A sheet tray according to another aspect of the present disclosure is mounted in a specific housing and allows a sheet to be conveyed into the housing to be placed thereon. The sheet tray includes a main tray, a downstream tray, and an elastic member. The main tray includes a first fastening portion, and a first support portion disposed at a lower end of the main tray and supported on the housing. The main tray is pivotable about an axis of the support portion to thereby open and close the housing. The main tray allows a sheet to be placed thereon in the state of opening the housing. The downstream tray includes a second fastening portion, and a second support portion supported on the housing at a position further inside the housing than the first support portion. The downstream tray overlaps the main tray, and is pivotable about an axis of the second support portion and thereby relatively movable with respect to the main tray. The downstream tray allows a downstream part of the sheet in a sheet conveying direction to be placed thereon. The elastic member is expandable and contractible. The elastic member has one end fastened on the first fastening portion of the main tray and the other end fastened on the second fastening portion of the downstream tray.

These and other objects, features and advantages of the present disclosure will become more apparent upon reading the following detailed description along with the accompanying drawings.

DETAILED DESCRIPTION

Figure 1:
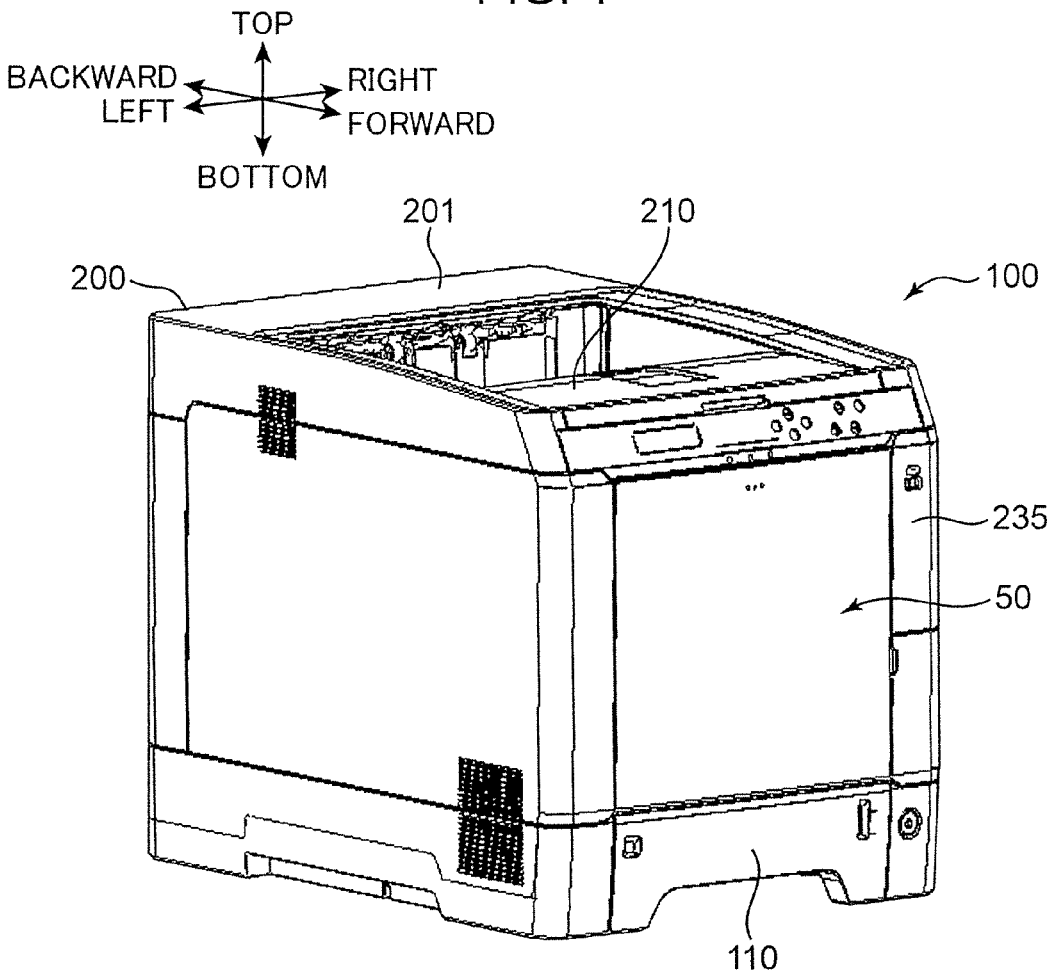
FIG. 1 is a perspective view of an image forming apparatus according to an embodiment of the present disclosure, a main tray of which being in a closed position.
Figure 2:
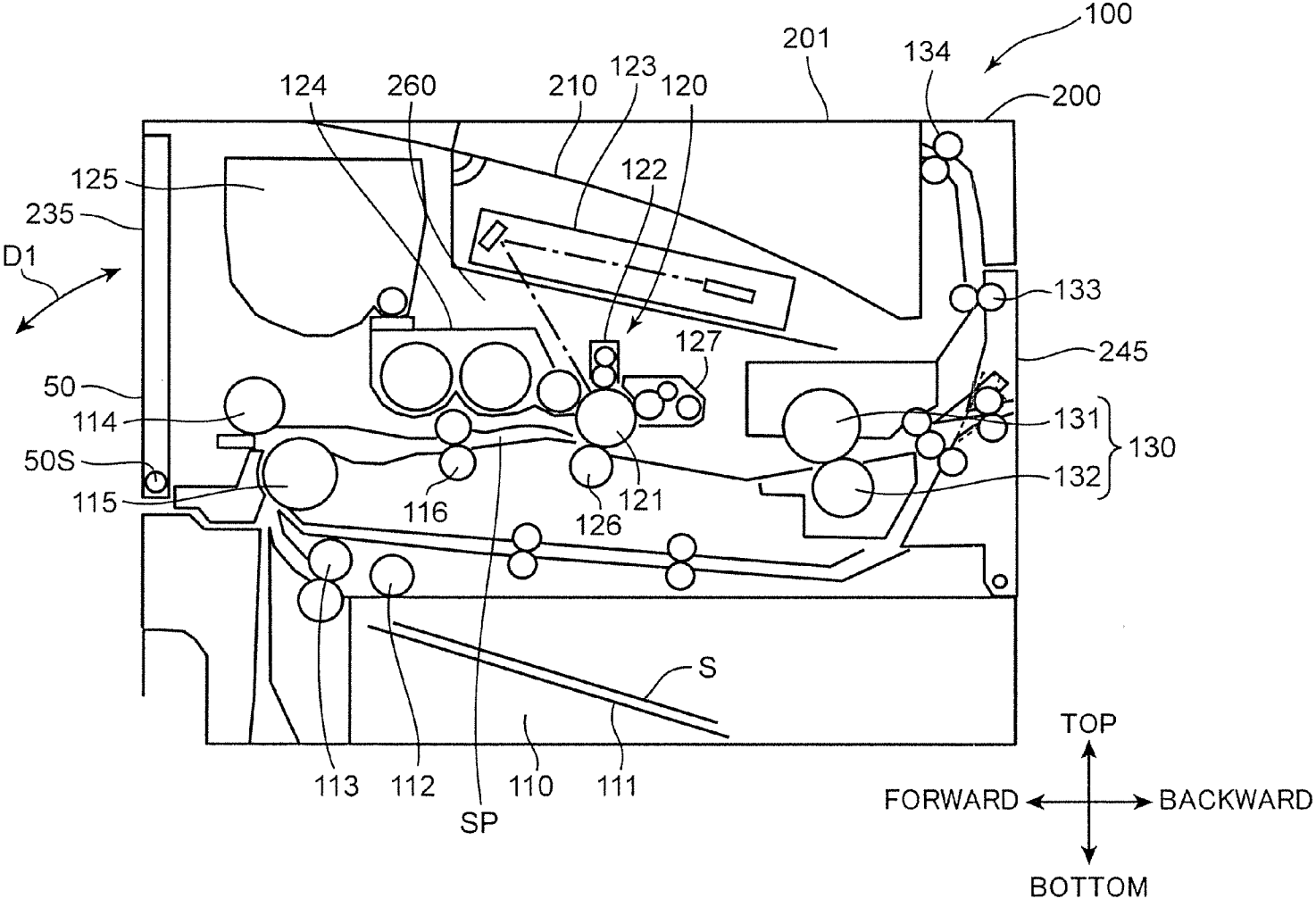
FIG. 2 is a schematic sectional view showing an internal structure of the image forming apparatus shown in FIG. 1.

Hereinafter, an embodiment of the present disclosure will be described with reference to the accompanying drawings. FIG. 1 is a perspective view of a printer 100 (image forming apparatus) according to an embodiment of the present disclosure. FIG. 2 is a schematic sectional view showing an internal structure of the printer 100 shown in FIG. 1. The printer 100 shown in FIGS. 1 and 2, which exemplifies the image forming apparatus, is a kind of so-called monochrome printer. However, other apparatuses may alternatively be provided as another type of image forming apparatus in other embodiments, such as a color printer, a facsimile apparatus or a multifunctional apparatus equipped with these functions, or another apparatus for forming a toner image on a sheet. It should be noted that hereinafter, terms indicating directions such as "top" "bottom" "forward" "backward"

"left" and "right" are intended merely for descriptive purposes, and not for limiting the principle of the image forming apparatus.

The printer 100 includes a housing 200 for housing various components which are used for forming an image on a sheet S. The housing 200 includes a top wall 201 defining the top surface of the housing 200, a rear wall 245 (FIG. 2) standing at the rear end of the housing 200, and a front wall 235 located in front of the rear wall 245. The housing 200 includes a main body internal space 260 (internal space) in which various components are placed. An internal conveyance passage SP (sheet conveyance passage) extends in the main body internal space 260, the internal conveyance passage SP being configured to allow passage of a sheet S. Further, the printer 100 includes a main tray 50 mounted on the housing 200 and configured to be openable and closeable with respect to the housing 200 (as shown by the arrow in FIG. 2).

A sheet discharge section 210 is disposed in a central part of the top wall 201. The sheet discharge section 210 has an oblique surface sloping downward from a front side to a rear side of the top wall 201. A sheet S having been subjected to image formation in an image forming section 120 is discharged onto the sheet discharge section 210.

With reference to FIG. 2, the printer 100 includes a cassette 110, a pickup roller 112, a first sheet feeding roller 113, a second sheet feeding roller 114, a conveying roller 115, a pair of registration rollers 116, and the image forming section 120.

The cassette 110 stores sheets S therein. The cassette 110 includes a lift plate 111 for supporting the sheets S. The lift plate 111 is tilted to lift leading edges of the sheets S. The cassette 110 defines a part of the front wall 235 of the housing 200 and can be pulled out forwardly with respect to the housing 200.

The pickup roller 112 is disposed above leading edges of sheets S lifted by the lift plate 111, and feeds the sheets S.

The first sheet feeding roller 113 is disposed downstream of the pickup roller 112, and delivers a sheet S further downstream. The second sheet feeding roller 114 is disposed inner than (behind) the pivot of the main tray 50, and draws a sheet S placed on the main tray 50 described later into the housing 200. A user can selectively use a sheet S stored in the cassette 110 or a sheet S placed on the main tray 50

The conveying roller 115 is disposed downstream of the first sheet feeding roller 113 in a sheet conveying direction (hereinafter, the sheet conveying direction also being referred to simply as "conveying direction", and the downstream in the sheet conveying direction also being referred to simply as "downstream"). The conveying roller 115 conveys a sheet fed by the first sheet feeding roller 113 or the second sheet feeding roller 114 further downstream.

The pair of registration rollers 116 functions to correct the angle of a sheet S that has been obliquely conveyed. This makes it possible to adjust the position of an image to be formed on the sheet S. The pair of registration rollers 116 supplies the sheet S to the image forming section 120 in accordance with timing of image formation to be performed by the image forming section 120.

The image forming apparatus 120 includes a photoconductive drum 121, a charger 122, an exposure device 123, a developing device 124, a toner container 125, a transferring roller 126, and a cleaning device 127.

The photoconductive drum 121 has a circumferential surface configured to have an electrostatic latent image formed thereon and carry a toner image corresponding to the electrostatic latent image. The charger 122 charges the circumferential surface of the photoconductive drum 121 substantially uniformly. The exposure device 123 irradiates the circumferential surface of the photoconductive drum 121 charged by the charger 122 with beams of laser light.

The developing device 124 supplies toner to the circumferential surface of the photoconductive drum 121, the circumferential surface having an electrostatic latent image formed thereon. The toner container 125 supplies toner to the developing device 124. The developing device 124 supplies toner to the photoconductive drum 121 to develop (visualize) the electrostatic latent image formed on the circumferential surface of the photoconductive drum 121.

The transferring roller 126 is disposed rotatably and in contact with the circumferential surface of the photoconductive drum 121. When a sheet S is conveyed by the pair of registration rollers 116 passes between the photoconductive drum 121 and the transfer roller 126, a toner image formed on the circumferential surface of the photoconductive drum 121 is transferred onto the sheet S.

The cleaning device 127 removes, after a toner image is transferred onto a sheet S from the circumferential surface of the photoconductive drum 121, toner remaining on the circumferential surface.

The printer 100 further includes a fixing device 130 for fixing a toner image on a sheet S, the fixing device 130 being disposed downstream of the image forming section 120 in the conveying direction. The fixing device 130 includes a heating roller 131 for melting toner on the sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the housing 200 by the pair of discharge rollers 134. The sheet S discharged from the housing 200 is placed on the sheet discharge section 210, thereby resulting in a stack of sheets.

Figure 3:
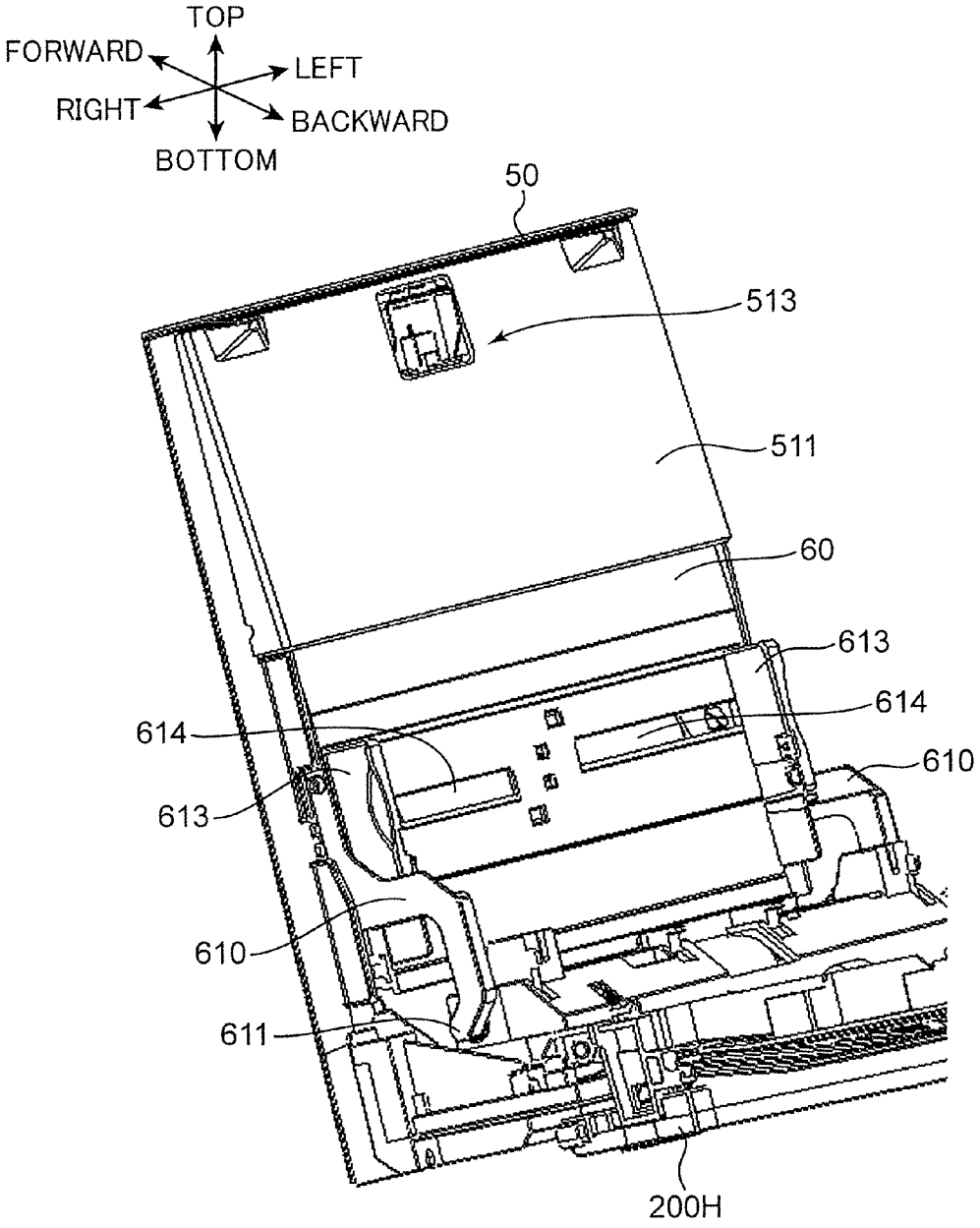
FIG. 3 is a perspective view of the main tray in the embodiment of the present disclosure.
Figure 4:
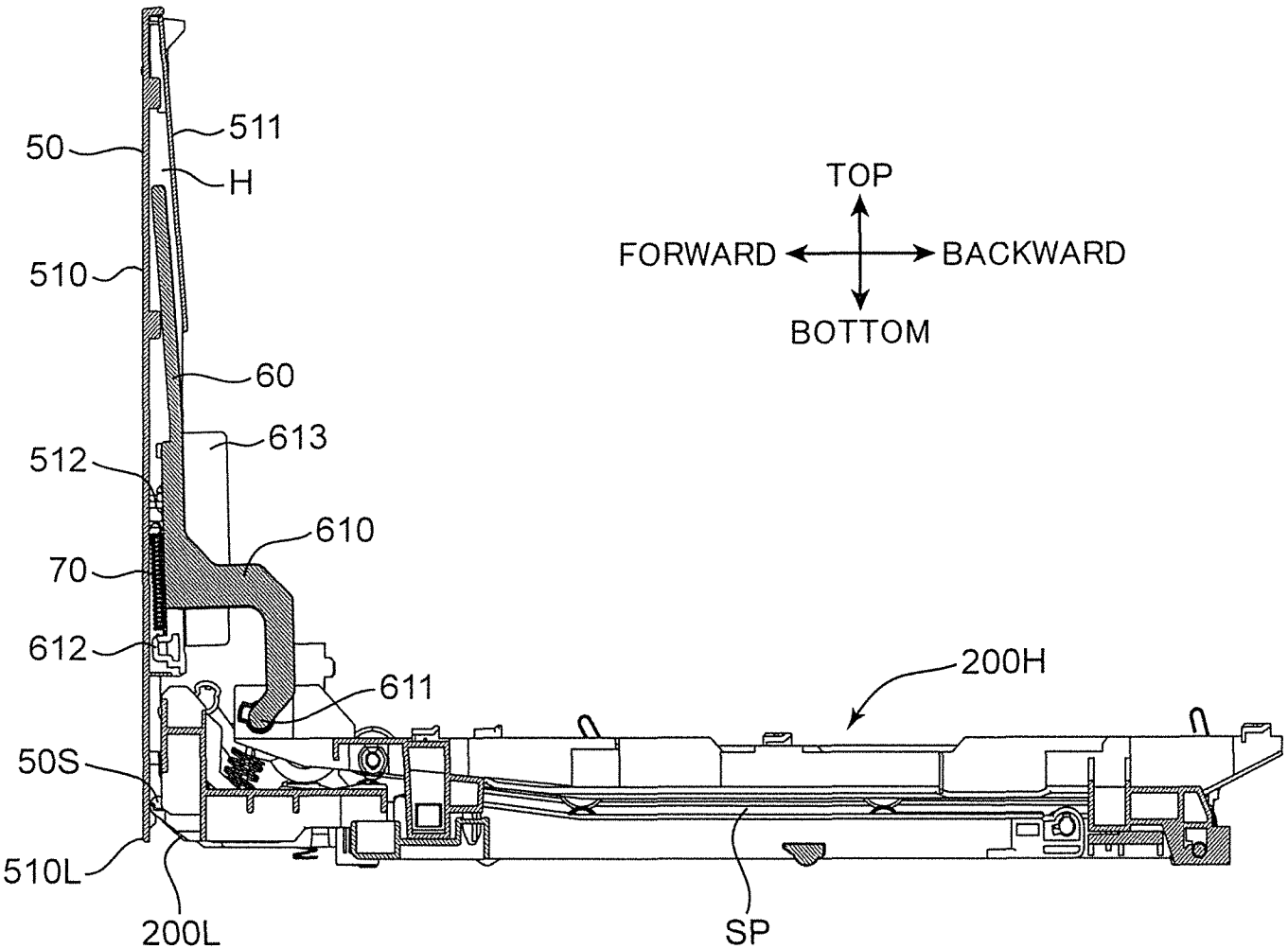
FIG. 4 is a sectional view illustrating a state where the main tray is in the closed position in the embodiment of the present disclosure.

Now, the structure of the main tray 50 and its surroundings in the embodiment will be described with reference to FIGS. 3 and 4. FIG. 3 is a perspective view of the main tray 50 in the embodiment. FIG. 4 is a sectional view illustrating the state where the main tray 50 is in a closed state with respect to the housing 200. The printer 100 includes, in addition to the above-mentioned main tray 50, a downstream tray 60, a pair of springs 70 (elastic member), and a conveyance frame 200H. In the embodiment, the main tray 50 and the downstream tray 60 constitute a manual feed tray configured to allow a sheet to be placed thereon. The conveyance frame 200H is disposed in the housing 200. A part of the internal conveyance passage SP extends in the conveyance frame 200H. The main tray 50, the downstream tray 60, and the springs 70 constitute a sheet tray of the present disclosure. The sheet tray is mounted in the housing 200, and allows a sheet S to be conveyed into the housing 200 to be placed thereon.

The main tray 50 serves as a cover member made of a resin material. The main tray 50 defines the front wall 235 of the housing 200 in the closed state with respect to the housing 200. The main tray 50 includes a cover support portion 505 (FIGS. 2 and 4) (first support portion), an outer cover portion 510 (main portion), an inner cover portion 511 (upstream tray), a pair of fastening portions 512 (first fastening portion) (FIG. 4), and an engaging portion (FIG. 3).

The cover support portion 505 is disposed at a lower end of the main tray 50 and acts as a pivot for opening/closing movement of the main tray 50. Specifically, the main tray 50 is pivotable about the cover support portion 505 to thereby be openable and closeable with respect to the housing 200. The cover support portion 505 is axially supported on the conveyance frame 200H. Further, the cover support portion 505 includes an unillustrated regulator for regulating the opening angle of the main tray 50 with respect to the housing 200. The outer cover portion 510 is a wall part of the main tray 50 that defines the front wall 235. The outer cover 510 has a rectangular shape extending vertically and horizontally. The inner cover portion 511 serves as a wall and is disposed further inside the housing 200 than the outer cover portion 510. The inner cover portion 511 defines a predetermined gap H with an upper part of the outer cover portion 510. The upper edge and the opposite side edges of the inner cover portion 511 are connected to the outer cover portion 510. The gap H is open at its lower end and communicates with the inside of the housing 200.

The cover fastening portions 512 are disposed on the rear surface of the outer cover portion 510. The cover fastening portions 512 each include an unillustrated hole, and allow one end of each of the springs 70 described later to be respectively fastened therein. The engaging portion 513 is disposed at an upper end of the inner cover portion 511. The engaging portion 513 engages with a locking mechanism 250 (FIG. 5B) of the housing 200.

The downstream tray 60 overlaps a lower part of the main tray 50. The downstream tray 60 includes a pair of arms 610, a pair of tray support portions 611 (second support portion), a pair of tray fastening portions 612 (second fastening portion), a pair of width regulation members 613, and a pair of slide grooves 614. The arms 610 are respectively disposed at the opposite side ends of the downstream tray 60. Each of the arms 610 has a substantially L shape. The tray support portions 611 are each disposed on respective lower ends of the pair of arms 610. The tray support portions 611 are disposed further inside the housing 200 than the cover support portion 50S. The tray support portions 611 are rotatably and axially supported on the conveyance frame 200H. The tray support portions 611 act as pivots for opening/closing movement of the downstream tray 60.

The downstream tray 60 is pivotable about the tray support portions 611 to thereby be openable and closeable with respect to the housing 200. At this time, in the embodiment, the downstream tray 60 is opened and closed with respect to the housing 200 integrally with the main tray 50. Specifically, an upper end of the downstream tray 60 is placed in (inserted into) the gap H defined between the outer cover portion 510 and the inner cover portion 511 (FIG. 4). In the course of opening operation of the main tray 50 with respect to the housing 200, the inner cover portion 511 pushes the upper end of the downstream tray 60 forward. This cases the upper end of the downstream tray 60 to slide along the outer cover portion 510 and the inner cover portion 511, thereby allowing the downstream tray 60 and the main tray 50 to be opened with respect to the housing 200 integrally. In this manner, the downstream tray 60 is slidable with respect to the main tray 50. The main tray 50 and the downstream tray 60 in the opened position allow a sheet S to be conveyed into the internal conveyance passage SP to be placed on their top surfaces. In particular, the inner cover portion 511 allows an upstream part of the sheet S in the conveying direction to be placed thereon and the downstream stray 60 allows a downstream part of the sheet S in the conveying direction to be placed thereon. The downstream tray 60 is made of a resin material, similarly to the main tray 50.

The tray fastening portions 612 are each disposed at respective base ends of the pair of arms 610. The tray fastening portions 612 are disposed at a predetermined distance below the cover fastening portions 512. As shown in FIG. 4, each of the tray fastening portions 612 includes a hole. The other ends of the springs 70 described later are respectively fastened in each of the tray fastening portions 612. The pair of width regulation members 613 (FIG. 3) are disposed on the downstream tray 60. The pair of width regulation members 613 regulate the position of a sheet S in a widthwise direction of the sheet S, the sheet S being placed on the main tray 50 and the downstream tray 60. The pair of slide grooves 614 is formed in an upper portion of the downstream tray 60 and extends in the sheet widthwise direction. The width regulation members 613 slide along the slide grooves 614 each via unillustrated rack and pinion. This makes it possible to regulate the positions of sheets S having different sizes from one another.

The pair of springs 70 is disposed inside the main tray 50. The springs 70 are respectively disposed at the opposite side ends of the main tray 50. As shown in FIG. 4, the upper ends (one ends) of the springs 70 are respectively fastened in each of the cover fastening portions 512. Further, the lower ends (the other ends) of the springs 70 are respectively fastened in each of the respective tray fastening portions 612.

Figure 5A:
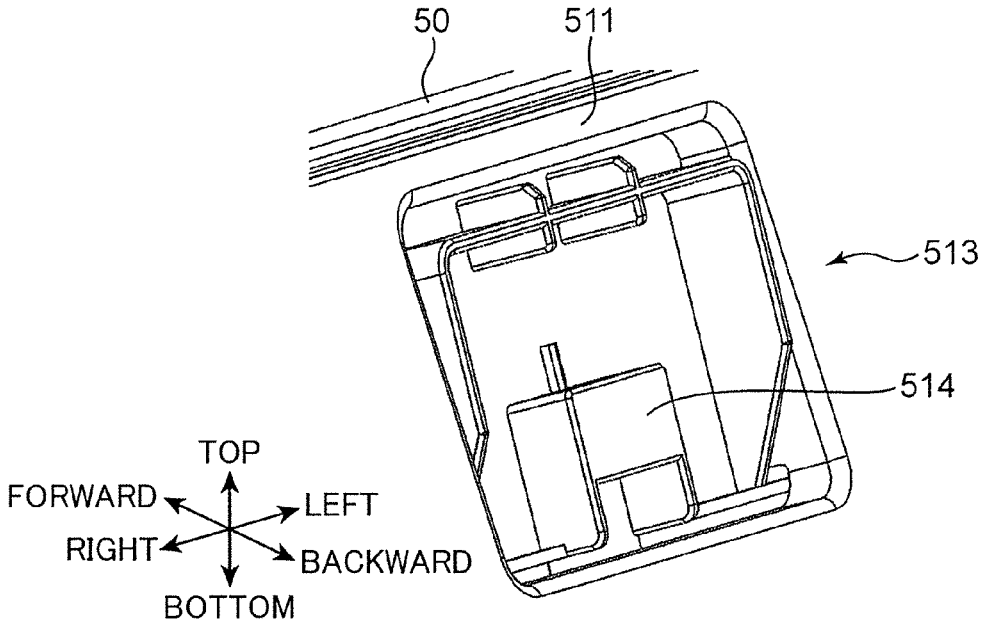
FIG. 5A is an enlarged perspective view of a part of the main tray in the embodiment of the present disclosure.
Figure 5B:
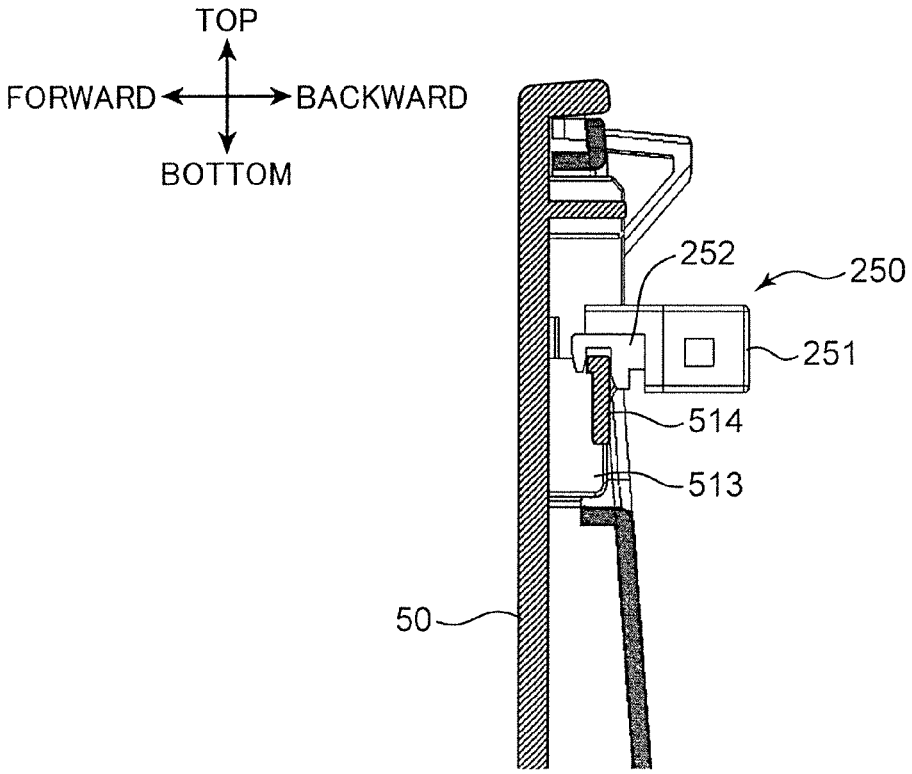
FIG. 5B is a sectional view illustrating a state where the main tray is locked by a locking mechanism in the embodiment of the present disclosure.
Figure 6C:
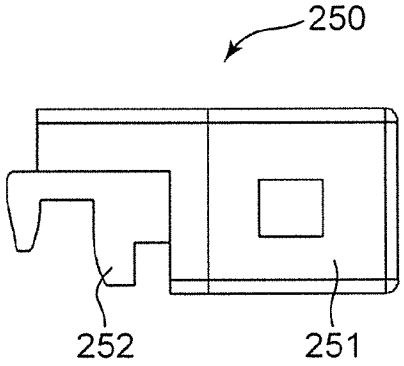
FIG. 6C is a side view illustrating a state of the locking mechanism that allows the main tray to be in the closed position.
Figure 6B:
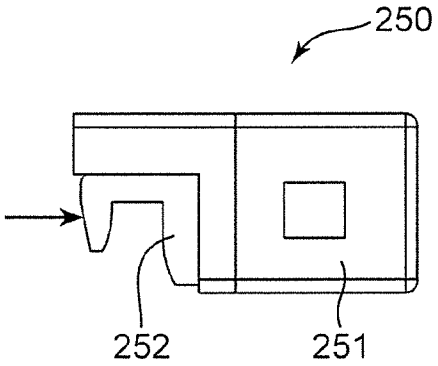
FIG. 6B is a side view illustrating a state of the locking mechanism that allows the main tray to be brought to the closed position in the embodiment of the present disclosure.
Figure 6A:
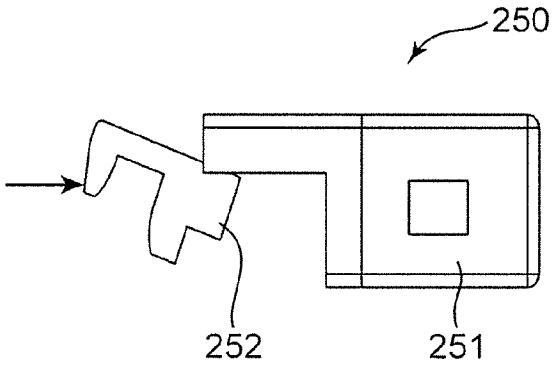
FIG. 6A is a side view illustrating a state of the locking mechanism that allows the main tray to be in an opened position in the embodiment of the present disclosure.

Now, the locking mechanism 250 for locking the main tray 50 to the housing 200 will be described. FIG. 5A is an enlarged perspective view of the fastening portion 513 of the main tray 50 in the embodiment. FIG. 5B is a sectional view illustrating the state where the main tray 50 is locked by the locking mechanism 250. FIG. 6A is a side view illustrating the state of the locking mechanism 250 that allows the main tray 50 to be in the open state with respect to the housing 200. FIG. 6B is a side view illustrating the state of the locking mechanism 250 that allows the main tray to be brought to the state of closing the housing 200. FIG. 6C is a side view illustrating the state of the locking mechanism 250 that allows the main tray 50 to be in the state of closing the housing 200.

With reference to FIG. 5A, the above-mentioned engaging portion 513 includes an abutting member 514 (engaging member). The abutting member 514 is disposed at a predetermined distance behind a covering surface of the inner cover portion 511. The abutting member 514 extends in the top-bottom direction when the main tray 50 is in the closed state with respect to the housing 200. With reference to FIG. 5B, the printer 100 includes the locking mechanism 250. The locking mechanism 250 is disposed in the housing 200 and faces the engaging portion 513. The locking mechanism 250 functions to lock the abutting piece 514. The locking mechanism 250 includes a hold portion 251 and a locking member 252. The locking mechanism 250 is in the form of a known push-to-close latch mechanism. The hold portion 251 is secured to the housing 200. The locking member 252 projects forward from the hold portion 251. A front end of the locking member 252 extends downward. An unillustrated biasing spring is elastically compressed between the hold portion 251 and the locking member 252.

With reference to FIGS. 5B and 6A, when a user brings the main tray 50 to the position of closing the housing 200, the upper edge of the abutting member 514 comes into contact with the tip end of the locking member 252, as shown by the arrow in FIG. 6A. Subsequently, the abutting member 514 pushes the locking member 252 into the hold portion 251, as shown by the arrow in FIG. 6B. At this time, the above-mentioned biasing spring is elastically compressed. The locking member 252 moves a predetermined distance in the forward direction as shown in FIG. 6C, at which the main tray 50 closes the housing 200 completely. At this time, an unillustrated regulation mechanism, which is disposed in the hold portion 251, regulates the position and location of the locking member 252. Thereafter, the upper edge of the abutting member 514 is fastened to the locking member 252 to thereby keep the main tray 50 being closed with respect to the housing 200 (FIG. 5B).

On the other hand, when a user pushes an upper end of the main tray 50 in the closed state into the housing 200, the locking member 252 is caused to move into the hold portion 251 again, i.e. move from the position shown in FIG. 6C to the position shown in FIG. 6B. At this time, the above-mentioned regulation of the locking member 252 by the regulation mechanism is released. The locking member 252 is caused to move in the forward direction by a force exerted by the biasing spring and returns to the position shown in FIG. 6A, i.e. the front end being in an upward oblique posture. Consequently, the locking mechanism 250 releases the locking of the abutting member 514 to allow the main tray 50 to move in the forward direction away from the housing 200 by its own weight to be opened with respect to the housing 200. As described, in the embodiment, the locking mechanism for the main tray 50 is configured in the form of the known push-to-close latch mechanism, thereby making it possible to bring the main tray 50 and the downstream tray 60 to the opened position easily.

Figure 7:
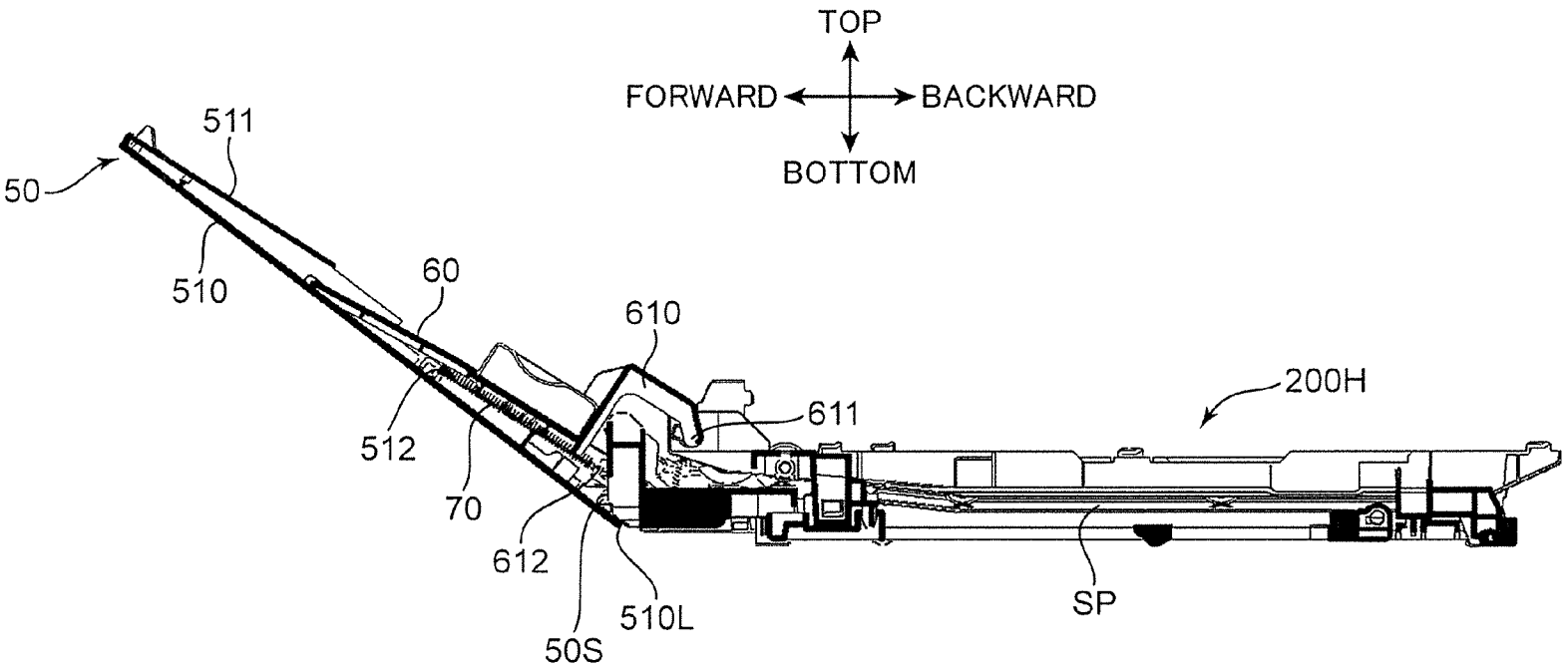
FIG. 7 is a sectional view illustrating the state where the main tray is in the opened position in the embodiment of the present disclosure.
Figure 8B:
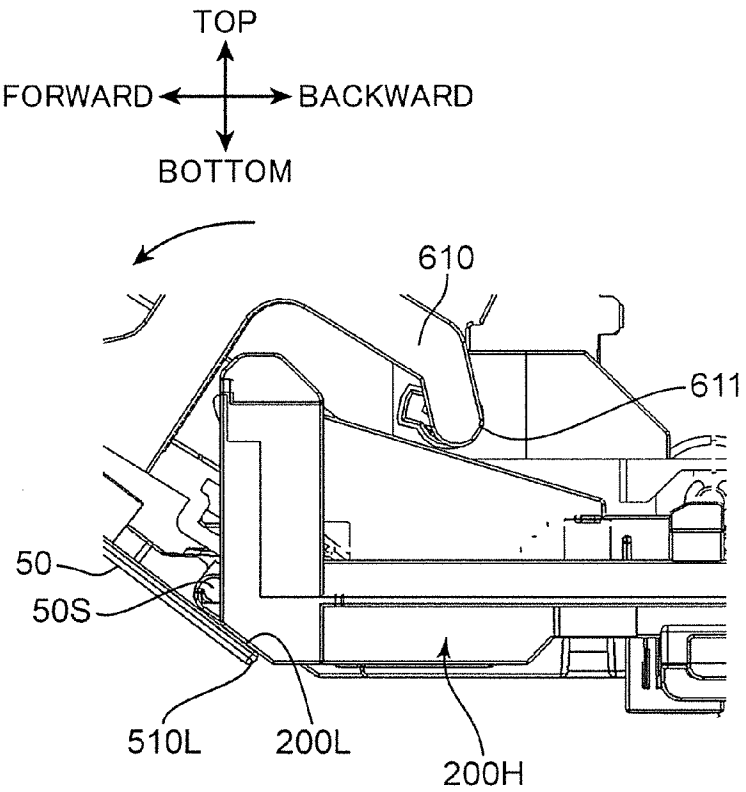
FIG. 8B is an enlarged side view illustrating the state where the main tray is in the opened position in the embodiment of the present disclosure.
Figure 8A:
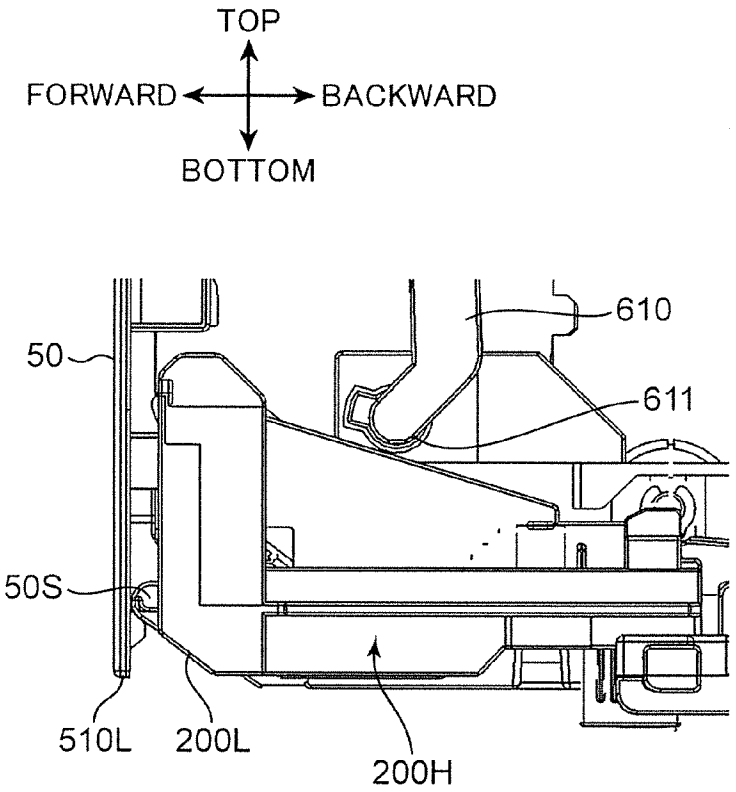
FIG. 8A is an enlarged side view illustrating the state where the main tray is in the closed position in the embodiment of the present disclosure.

Now, the opening/closing movement of the main tray 50 and the downstream tray 60 will be further described in detail with reference to FIGS. 7, 8A, and 8B in addition to FIG. 4. FIG. 7 is a sectional view illustrating the state where the main tray 50 is in the open state with respect to the housing 200. FIG. 8A is an enlarged side view illustrating the state where the main tray 50 is in the closed state. FIG. 8B is an enlarged side view illustrating the state where the main tray 50 is in the open state.

With reference to FIG. 8A, the main tray 50 includes a cover lower end 510L (contact portion). The cover lower end 510L is defined by a lower end of the outer cover portion 510. The cover lower end 510L extends below the cover support portion 505, and has an elastically deformable free end. On the other hand, the conveyance frame 200H includes a frame abutting portion 200L (abutted portion). The frame abutting portion 200L is defined by a surface of the conveyance frame 200H that is located at the lower front end of the conveyance frame 200H. The frame abutting portion 200L is defined by an oblique surface sloping upward in the forward direction. The frame abutting portion 200L is sloping at such an angle as to extend along the main tray 50 in the open state with respect to the housing 200. Further, the frame abutting portion 200L is so disposed as to lie at a distance behind the cover lower end 510L when the main tray 50 is in the closed state with respect to the housing 200.

When the main tray 50 is in the closed state as shown in FIG. 4, the springs 70 respectively fastened in each of the cover fastening portions 512 and each of the tray fastening portions 612 have a free length. When a user pushes the upper end of the main tray 50 in this state, the locking of the main tray 50 by the locking mechanism 25 is released, as described above. This allows the main tray 50 to move for opening, in response to the pushing force applied thereon and by its own weight. At this time, the main tray 50 pivots about the cover support portion 50S, and the downstream tray 60 pivots about the tray support portions 611.

The upper end of the downstream tray 60 slides in the direction away from the gap H in the course of opening movement of the main tray 50. At this time, the distance between the cover fastening portions 512 and the tray fastening portions 612 gradually increases owing to the different locations of the respective pivots of the main tray 50 and the downstream tray 60. Thus, the distance between the cover fastening portions 512 and the tray fastening portions 612 is greater when the main tray 50 and the downstream tray 60 are in the open state with respect to the housing 200 than when the main tray 50 and the downstream tray 60 are in the closed state with respect to the housing 200. The spring 70 expands as the distance between the cover fastening portions 512 and the tray fastening portions 612 gradually increases. Thereafter, the main tray 50 is caused to move toward the housing 200 by the restoring force of the spring 70, which decreases the opening speed of the main tray 50, and consequently permits a reduced shock to occur when the main tray 50 reaches a predetermined opening angle. Consequently, the main tray 50 is prevented from rebounding (moving back and forth while bouncing) in the course of opening. In particular, in the embodiment, the restoring force of the springs 70 is exerted on the main tray 50, which reliably decreases the opening speed of the main tray 50.

When the main tray 50 moves to open by its own weight, the opening speed of the main tray 50 is likely to increase according to the increase in the angle of opening of the main tray 50. In consideration of this, in the embodiment, the elastically deformable cover lower end 510L is provided in addition to the springs 70. Specifically, as shown in FIG. 8B, at the same time as or immediately before the main tray 50 reaches the opening angle, the cover lower end 510L comes into contact with the frame abutting portion 200L and elastically deforms slightly. In other words, the cover lower end 510L bends against the remaining outer cover portion 510. The elastic deformation of the cover lower end 510L makes it possible to absorb the impact on the main tray 50 in the course of opening to thereby further prevent the main tray 50 from rebounding.

The printer 100 (image forming apparatus) according to the embodiment of the present disclosure has been described. However, the present disclosure is not limited to the above-described embodiment and, for example, the following modified embodiments may be adopted.

(1) In the above-described embodiment, the elastic member is illustrated as the springs 70. However, the present disclosure is not limited to this configuration. An elastically deformable rubber member may be used in place of each of the springs 70.

(2) Further, in the above-described embodiment, each of the arms 610 of the downstream tray 60 is in the form of a single arm member. However, the present disclosure is not limited to this configuration. Each of the arms 610 may be configured to have two arm members and an unillustrated joint, so that the arm 610 is bendable at the joint.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

a housing including an internal space;

a sheet conveyance passage extending in the internal space;

a main tray including a first fastening portion and a first support portion disposed at a lower end of the main tray, the main tray being pivotable about an axis of the first support portion to thereby be openable and closeable with respect to the housing, and allow a sheet to be conveyed into the sheet conveyance passage to be placed thereon in an open state with respect to the housing;

a downstream tray including a second fastening portion and a second support portion disposed farther inside the housing than the first support portion, the downstream tray overlapping the main tray, and being pivotable about an axis of the second support portion and thereby relatively movable with respect to the main tray to allow a downstream part of the sheet in a sheet conveying direction to be placed thereon; and an elastic member that is expandable and contractible, the elastic member having a first end fastened on the first fastening portion of the main tray and a second end fastened on the second fastening portion of the downstream tray, wherein:

the main tray includes a contact portion extending below the first support portion and having an elastically deformable free end, the housing includes an abutted portion that lies apart from the contact portion in a closed state of the main tray, and the contact portion comes into contact with the abutted portion and elastically deforms at the same time as or immediately before the main tray reaches a predetermined opening angle in the course of an opening operation of the main tray.

2. An image forming apparatus according to claim 1, wherein the distance between the first fastening portion and the second fastening portion in the open state of the main tray is greater than the distance between the first fastening portion and the second fastening portion in a closed state of the main tray, and whereby the elastic member expands in the course of an opening operation of the main tray, and the opening speed of the main tray decreases owing to a restoring force of the elastic member.

3. An image forming apparatus according to claim 1, wherein the main tray includes an engaging member disposed at an upper end of the main tray, the housing includes a locking mechanism facing the engaging member and operable to lock the engaging member, the locking mechanism releasing the locking of the engaging member to allow the main tray to move by its weight to be opened with respect to the housing when the main tray is pushed inward of the housing in a closed state of the main tray.

4. An image forming apparatus according to claim 1, wherein:

the main tray includes a main portion defining one side wall of the housing, and an upstream tray disposed farther inside the housing than the main portion and defining a predetermined gap to an upper part of the main portion, the upstream tray being configured to allow an upstream part of the sheet in the sheet conveying direction to be placed thereon;

an upper end of the downstream tray is inserted into the gap between the main portion and the upstream tray; and the upstream tray pushes the upper end of the downstream tray to cause the upper end of the downstream tray to slide along the main portion and the upstream tray in the course of an opening operation of the main tray, thereby allowing the downstream tray and the main tray to be integrally opened with respect to the housing.

5. A sheet tray configured to be mounted in a specific housing and allow a sheet to be conveyed into the housing to be placed thereon, the sheet tray comprising:

a main tray including a first fastening portion and a first support portion disposed at a lower end of the main tray and supported on the housing, the main tray being pivotable about an axis of the first support portion to thereby be openable and closeable with respect to the housing and allow a sheet to be placed thereon in an open state;

a downstream tray including a second fastening portion, and a second support portion supported on the housing at a position farther inside the housing than the first support portion, the downstream tray overlapping the main tray, and being pivotable about an axis of the second support portion and thereby relatively movable with respect to the main tray to allow a downstream part of the sheet in a sheet conveying direction to be placed thereon; and an elastic member that is expandable and contractible, the elastic member having a first end fastened on the first fastening portion of the main tray and a second end fastened on the second fastening portion of the downstream tray, wherein:

the main tray includes a main portion defining one side wall of the housing, and an upstream tray disposed farther inside the housing than the main portion and defining a predetermined gap to an upper part of the main portion, the upstream tray being configured to allow an upstream part of the sheet in the sheet conveying direction to be placed thereon;

an upper end of the downstream tray is inserted into the gap between the main portion and the upstream tray; and the upstream tray pushes the upper end of the downstream tray to cause the upper end of the downstream tray to slide along the main portion and the upstream tray in the course of an opening operation of the main tray, thereby allowing the downstream tray and the main tray to be integrally opened with respect to the housing.

6. An image forming apparatus, comprising:

a housing including an internal space;

a sheet conveyance passage extending in the internal space;

a main tray including a first fastening portion and a first support portion disposed at a lower end of the main tray, the main tray being pivotable about an axis of the first support portion to thereby be openable and closeable with respect to the housing, and allow a sheet to be conveyed into the sheet conveyance passage to be placed thereon in an open state with respect to the housing;

a downstream tray including a second fastening portion and a second support portion disposed farther inside the housing than the first support portion, the downstream tray overlapping the main tray, and being pivotable about an axis of the second support portion and thereby relatively movable with respect to the main tray to allow a downstream part of the sheet in a sheet conveying direction to be placed thereon; and an elastic member that is expandable and contractible, and the elastic member having a first end fastened on the first fastening portion of the main tray and a second end fastened on the second fastening portion of the downstream tray, wherein the main tray includes a main portion defining one side wall of the housing, and an upstream tray disposed farther inside the housing than the main portion and defining a predetermined gap to an upper part of the main portion, the upstream tray being configured to allow an upstream part of the sheet in the sheet conveying direction to be placed thereon;

an upper end of the downstream tray is inserted into the gap between the main portion and the upstream tray; and the upstream tray pushes the upper end of the downstream tray to cause the upper end of the downstream tray to slide along the main portion and the upstream tray in the course of an opening operation of the main tray, thereby allowing the downstream tray and the main tray to be integrally opened with respect to the housing.

7. An image forming apparatus according to claim 6, wherein the distance between the first fastening portion and the second fastening portion in the open state of the main tray is greater than the distance between the first fastening portion and the second fastening portion in a closed state of the main tray, and whereby the elastic member expands in the course of an opening operation of the main tray, and the opening speed of the main tray decreases owing to a restoring force of the elastic member.

8. An image forming apparatus according to claim 6, wherein the main tray includes an engaging member disposed at an upper end of the main tray, the housing includes a locking mechanism facing the engaging member and operable to lock the engaging member, the locking mechanism releasing the locking of the engaging member to allow the main tray to move by its weight to be opened with respect to the housing when the main tray is pushed inward of the housing in a closed state of the main tray.

* * * * *